United States Patent [19]

Reuting

[11] 4,042,799

[45] Aug. 16, 1977

[54] DAMPING OF CONTACTS

[75] Inventor: Hans Werner Reuting, Peine, Germany

[73] Assignee: ELMEG Elektro-Mechanik GmbH, Peine, Germany

[21] Appl. No.: 613,362

[22] Filed: Sept. 15, 1975

[30] Foreign Application Priority Data

Sept. 21, 1974 Germany ..... 2445176

[51] Int. Cl.[2] ..... H01H 3/60

[52] U.S. Cl. ..... 200/288; 200/DIG. 46; 335/154; 335/193

[58] Field of Search ..... 200/288, 283, 246, 1 TK, 200/1 B, 1 V, DIG. 46; 335/154, 193

[56] References Cited

U.S. PATENT DOCUMENTS

| | | | |
|---|---|---|---|
| 1,400,126 | 12/1921 | Wotton | 200/288 |
| 3,134,868 | 5/1964 | Shine | 335/154 |
| 3,348,175 | 10/1967 | Wilkis | 335/154 |
| 3,525,836 | 8/1970 | Hanhart | 200/288 |

FOREIGN PATENT DOCUMENTS

| | | |
|---|---|---|
| 1,052,510 | 3/1959 | Germany |
| 1,123,015 | 2/1962 | Germany |

*Primary Examiner*—Robert K. Schaefer
*Assistant Examiner*—Morris Ginsburg
*Attorney, Agent, or Firm*—Ralf H. Siegemund

[57] ABSTRACT

Contact springs are damped against resilient bouncing in that thin plastic foil covers one or both sides of the spring. The foil, when extending into the zone of clamping one end of the spring, is used to maintain specific tolerances in contact positioning. The foil should have low cold flow characteristics and high reversible elasticity, such as folacron or polysulphonic plastic.

8 Claims, 1 Drawing Figure

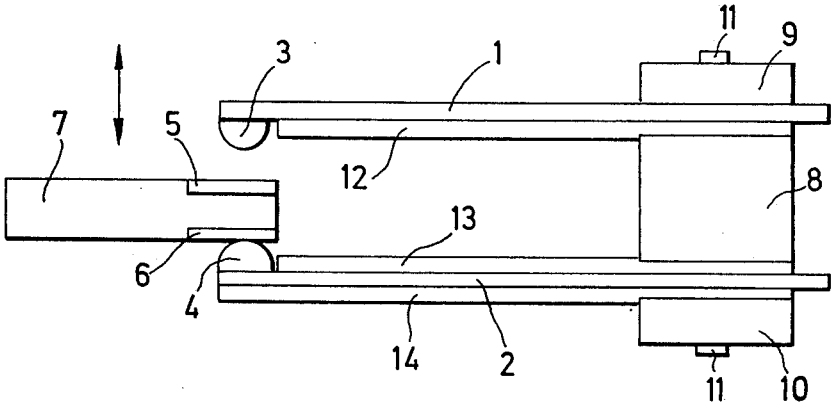
11
9
3
1
7
5
12
8
13
6
4
14
2
11
10

DAMPING OF CONTACTS

BACKGROUND OF THE INVENTION

The invention relates to contact systems in electric switch gear in which at least one of two cooperating contacts is associated with a soft resilient damping member.

Contact systems with clamping members for avoiding, or least attenuating, contact bouncing, are, e.g., known through German printed patent applications Nos. 1,052,510 and 1,123,015. These known damping members are rather compact bodies and they are directly connected to the backside of a contact or a contact bridge. The particular contact or contact bridge is either actuated via the clamping body or bears against such a body or bodies so that during contact actuation the damping bodies are deformed for absorbing kinetic energy which, if not absorbed, leads to bouncing and oscillations.

Specific contact arrangements are known and used, for example, in electromagnetic relays, wherein at least some of the contacts are carried by contact springs. Such springs are advantageous for producing contact pressure, but they are quite prone to bouncing. Damping members of the known variety cannot be mounted on such springs for the following reason. Assuming one would place a damping body behind a contact that is supported by and mounted on a contact spring, such body would have to be supported in some fashion by a stationary surface. Thus, upon engagement with that body, the contact would appear to be supported by that stationary surface, the damping body serving merely as spacer. At that point, some or even most of the resiliency of the contact mount is lost and no longer available for furnishing contact pressure.

DESCRIPTION OF THE INVENTION

It is an object of the present invention to reduce the tendency to bounce in spring mounted contacts.

In accordance with the preferred embodiment of the invention, it is suggested to cover at least one side of a contact spring with a thin layer (foil) of plastic, the contact of the contact spring cooperating with a movable contact. The one end of the spring, not carrying the contact, is for example, clamped to a stationary device in which the foil can extend into the clamping zone to contribute to the determination of the relative position of the contact spring, e.g., in relation to another one. While one side covering readily suffices in most instances enhanced damping is obtained if both flat sides of the contact springs are covered by plastic foil; one side completely, the other side almost completely except for the contact it carries.

The foil can be joined to the contact spring simply by, for example, the application of heat or by adhesive means. The foil as covering at least one spring side, offers the additional advantage that the contact spring is also electrically insulated on that side. This can be exceptionally advantageous, if electrical connection to the moving contact is made by means of an uninsulated flexible conductor. The insulation foil on the contact spring ensures that no undesirable electric contact is made therewith.

In the preferred form, plastic is to be used having low cold flow characteristics and high reversible elasticity. "Low" and "high" is to refer here to the properties found, for example, in a material traded under the designation folacron or a polysulphonic plastic. These materials constitute the preferred form of practicing the invention. With such a construction the plastics film is resiliently compressed when the contact spring is clamped to compensate any existing tolerances of, e.g., a spacer between two contact springs so that they can be clamped at a precise distance from each other. Moreover, it was found that such a material will not dry out; any changes of the inserts are subsequently compensated by the reversible elasticity of the foil material so that the system not only maintains the correct distance between contact springs, but also the clamping thereof is maintained in a reliable manner.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

The FIGURE is a side-view of a contact system in accordance with the preferred embodiments.

Proceeding now to the detailed description of the drawings, the FIGURE shows two fixed contacts 3 and 4, which are mounted respectively on contact springs 1 and 2. The said fixed contacts 3 and 4 co-operate respectively with two moving contacts 5 and 6, which are supported by a movable contact carrier or support 7. The contact support 7 is made of insulating material and, therefore, provides electrical insulation between the two moving contacts 5 and 6. As the contact support 7 is moved in the direction of the double arrow the co-operating contacts comprising either the fixed contact 3 and the moving contact 5 or the fixed contact 4 and the moving contact 6 will, therefore, close or open respectively.

The contact springs 1 and 2 are clamped at a predefined distance from each other. Particularly, an insulating insert or spacer 8 is provided which substantially defines the distance between the contact springs 1 and 2. These contact springs are constructed as leaf springs, one of their principal flat surfaces being oriented towards the insert 8. Insulating material members 9 and 10 are provided on the side of the other principal flat surfaces of the contact springs and are pressed against each other by means of rivet or screw connections 11 penetrating into the insert 8, so that the latter is firmly clamped between the contact springs 1 and 2.

The principal surface of spring 1 which faces downwardly in the direction towards the insert 8 is provided with a plastic layer, foil or film 12, which covers said principal surface up to a location immediately before the fixed contact 3. Both of the principal flat surfaces of the bottom contact spring 2 are provided with similar plastic foils or film 13 and 14 respectively.

All these plastic layers 12, 13 and 14 cover the appropriate surfaces of the contact springs 1 and 2, and in this example they also cover the respective surface portions in the entire clamping zone. These plastic layers 12, 13 and 14 are bonded or heat sealed or otherwise affixed to the respective spring. A preferred mode of procedure will be described below.

When the contacts are operated, kinetic energy is transmitted from the contact carrier 7 to the fixed contacts 3 and 4 and, therefore, to the contact springs 1 and 2. A substantial portion of that kinetic energy is converted into other forms of energy including energy stored by operation of the deformation of the plastic layers 12, 13, and 14. The energy thus stored in these layers is not stored as resilient energy in the contact springs, so that the tendency of the contact springs 1 and 2 to oscillate and, therefore, the tendency of the contacts to bounce is substantially reduced. The degree to which the tendency to bounce is reduced naturally depends on the thickness and kind of plastic layers. The bottom contact spring 2 is more strongly damped, because both of its sides are covered with the plastic foils 13 and 14, the top contact spring 1 being damped to a lesser degree accordingly.

The plastic films or foils 12, 13, and 14 not only dampen and attenuate the contact spring oscillations, but they also participate in the particularly advantageous manner as regards precise and simple clamping of the contact springs. The manufacture of the insert 8 and of the insulating members 9 and 10 as well as the attachment of the rivet or screw connection 11 is naturally subject to dimensional tolerances. In the absence of plastics films, these tolerances have a detrimental effect on precise clamping of the contact springs 1 and 2.

For example, if a dimension is defined by stop abutments for the outer edges of the insulating members 9 and 10 it is not possible to ensure firm clamping of the contact springs 1 and 2, because of the tolerances of the insulating material members 9 and 10 and of the insert 8 without the presence of the plastic foils 12, 13 and/or 14. However, due to their cold-flow characteristics and their reversible elasticity, the plastic foils provide tolerance compensation. In order to elaborate on this point, it is specifically desirable, if the plastic foil material exhibits a rather low tendency to cold flow, but has a high reversible elasticity. It was found that a foil made of a material traded under the name folacron or a polysulfonic plastic is well suited for this purpose. Thus, if foils 12, 13, and 14 are made of such a material, they are readily elastically compressed upon assembling the springs 1, 2 with elements 8, 9, 10, and 11. Any tolerances can thus be compensated and the springs 1, 2 obtain the desired distances between each other. The application of the force required for adequate clamping of the springs is ensured at all times by the reversible elasticity even if the insulating material members do exhibit some cold-flow in the course of time. The choice of the dimensions must, of course, be adapted to the particular materials used. The resiliency permitting some relaxation will compensate any effect of cold flow so that the adjusted dimensions remain. On the other hand, the contact springs remain securely clamped. It can readily be seen that selective omission of foil 14, at least as far its extension into the clamping zone is concerned, offers an additional extension of the range for tolerances that can be compensated. The relatively thin insulating material members 9 and 10 are not subject to any substantial dimensional changes.

On the other hand, it is also possible to ensure a fairly accurate distance between springs by employing a relatively accurately dimensioned insert 8 and by using plastics foils in the clamping zone only on the sides which face away from the insert 8, but without having to satisfy stringent accuracy requirements for the rivet or screw connection 11. The elastic foils absorb riveting or screw fastening forces and provide tolerance compensation while hard clamping on the other hand would call for great care in controlling the clamping forces of the rivet or screw connections 11, a fact which is of particular significance where several spring pairs are mounted one upon another.

The inward-facing principal surfaces of the contact springs 1 and 2 are covered with plastics foil 12 and 13, which serve also as insulator. This offers the advantage that electric leads constructed, for example, as stranded conductors — and even without insulation envelope, can still be disposed between the two contact springs 1 and 2 and extend right to the moving contacts 5 and 6 for connection thereto. The flexibility of such leads permits ready adaptation to the different positions of the carrier 7, and the insulation against the contact springs is provided by the plastic layers 12, 13, etc. The attachment of plastic layers and covers to other surfaces of the contact springs may also be advantageous in the interest of additional insulation.

The invention is not confined to the illustrated embodiment. For example, the moving contacts can be attached to contact springs which are also covered with plastic foils layers, etc. for the purpose of damping and improved clamping and insulation. The invention can also be applied to stacks of springs containing substantially more than just two contact springs. In this case, the application of plastics films has an even more favorable effect as regards precise clamping and positioning, because tolerances can be more readily offset; each contact spring has at least one, possibly two plastic layers or foils which can be squeezed on tightening the entire stack together.

It should be mentioned that the particular plastic material proposed above is rather simply applied to the contact springs 1 and 2. For example, the springs are heated and the pieces of foil are simply applied possibly under development of some pressure and additional heat. The bonding suffices readily even without use of an adhesive.

Compared with known control systems with damping members the contact systems according to the invention offers the further advantage, as already indicated, of exceptionally simple and low-cost production and application of the damping members 12, etc. This is particularly advantageous if the contact springs employed in the contact system according to the invention are produced by a method which is characterized in that a suitable spring plate or strip is covered on one or both sides with a foil or foils of plastic material and joined thereto, e.g., in the stated fashion. Next, the contact springs are punched out of the sheet or strip metal as covered with the foil(s). This dispenses with the need for a separate coating of each individual contact spring and thus dispenses with the individual application of damping members which is necessary in known contact systems having damping members. Instead, the plastic layer is applied, prior to the punching operation, to a long bronze strip from which the contact springs are punched. The punching operation is not hindered in any way by the presence of the plastics film.

The invention is not limited to the embodiments described above, but all changes and modifications thereof not constituting departures from the spirit and scope of the invention are intended to be included.

I claim:

1. Contact arrangement in switching devices having at least one movable contact and a stationary contact mounted on a contact spring;

means for clamping one end of the contact spring, the contact spring having at least one of its flat surfaces at least partially covered individually by a plastic foil, being bonded thereto and extending into a zone of clamping as between said means and the one spring end for offsetting positioning tolerances, said foil having low cold flow characteristics and high reversible elasticity such as exhibited by a polysulfonic plastic.

2. Contact arrangement as in claim 1, and including a contact carrier, said movable contact being mounted on said contact carrier, a second contact on the contact carrier, a second stationary contact spring on said means for clamping, and being also provided with a plastic foil being bonded thereto.

3. Contact arrangement as in claim 1, said foil covering entirely one flat side of the spring and extending from the means for clamping towards the movable contact and held in the means for clamping.

4. Contact arrangement as in claim 1, said foil extending up to the stationary contact without covering it.

5. Contact arrangement as in claim 1, said foil made of a material traded under the designation folacron.

6. Contact arrangement as in claim 1, said foil made of a polysulfonic plastic.

7. Contact arrangement as in claim 1, said foil and contact spring having common punch-out edges, the foil having been affixed prior to punch-out.

8. A contact arrangement comprising:

a clamping member including a first and a second insulating member and a spacer member being fastened together;

a first and a second contact spring mounted respectively between the first and second insulating members on the one hand, and the spacer member on the other hand; and each of said contact springs having at least one of its flat surfaces covered with a foil made of a material having low cold flow characteristics and high reversible elasticity such as exhibited by a polysulfonic plastic and being bonded to the respective contact spring and extending over at least the predominant part of the length of the contact springs, at least one of the foils extending into a zone of clamping as between the respective insulating member and the spacer for offsetting tolerances of spacing by the spacer member.

* * * * *